US007036896B2

(12) United States Patent
Kim

(10) Patent No.: US 7,036,896 B2
(45) Date of Patent: May 2, 2006

(54) APPARATUS AND METHOD OF ADJUSTING A HEAD GAP IN AN INKJET PRINTER

(75) Inventor: Jung-hwan Kim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 198 days.

(21) Appl. No.: 10/613,196

(22) Filed: Jul. 7, 2003

(65) Prior Publication Data

US 2004/0017410 A1 Jan. 29, 2004

(30) Foreign Application Priority Data

Jul. 4, 2002 (KR) ..... 2002-38687

(51) Int. Cl.
*B41J 25/308* (2006.01)
*B41J 2/01* (2006.01)

(52) U.S. Cl. ..... 347/8; 347/101

(58) Field of Classification Search ..... 347/5, 347/8, 19, 101, 104; 400/55, 56, 57, 58, 400/59; B41J 29/38, 25/308, 29/393, 11/20
See application file for complete search history.

(56) References Cited

U.S. PATENT DOCUMENTS 4,843,338 A * 6/1989 Rasmussen et al. ..... 347/8
4,917,512 A * 4/1990 Mimura et al. ..... 400/56
4,927,277 A * 5/1990 Niikawa ..... 400/56
4,990,004 A * 2/1991 Kawahara et al. ..... 400/56
5,051,008 A * 9/1991 Honda et al. ..... 400/59
5,678,936 A * 10/1997 Hino ..... 400/55
5,838,338 A * 11/1998 Olson ..... 347/8

FOREIGN PATENT DOCUMENTS

JP 04161369 A * 6/1992
JP 08142442 A * 6/1996

* cited by examiner

*Primary Examiner*—Manish Shah
*Assistant Examiner*—Leonard Liang
(74) *Attorney, Agent, or Firm*—Staas & Halsey LLP

(57) ABSTRACT

An apparatus and method of adjusting a head gap in an inkjet printer includes a carrier ascent/descent unit to rotate a carrier shaft having ends of which are in an eccentric cam shape to ascend and descend the carrier. The apparatus also includes a clutch unit to transfer a driving force of the paper supply roller driving unit to the carrier shaft by the carrier in order to rotate the carrier ascent/descent unit upon the adjustment of the head gap, and a control unit to store an adjusted head gap state and to adjust a head gap position required based on the stored head gap state. Accordingly, the present invention may automatically adjust the head gap according to a thickness of a sheet of paper to be printed on by using a driving force of a carrier driving unit and the driving force of the paper supply roller driving unit without using an extra driving motor and head gap sensor.

26 Claims, 9 Drawing Sheets

APPARATUS AND METHOD OF ADJUSTING A HEAD GAP IN AN INKJET PRINTER

CROSS-REFERENCE TO RELATED APPLICATIONS

This application claims the benefit of Korean Application No. 2002-38687, filed Jul. 4, 2002, in the Korean Intellectual Property Office, the disclosure of which is incorporated herein by reference.

BACKGROUND OF THE INVENTION

1. Field of the Invention

The present invention relates to an apparatus and method of adjusting a head gap in an inkjet printer, and more particularly, to an apparatus and method of adjusting a head gap in an inkjet printer capable of automatically adjusting a gap between a sheet of paper and a printer head depending upon variations of sheet thickness.

2. Description of the Related Art

In general, an inkjet printer, as shown in FIG. 1, includes a printer head 30 having a nozzle 31 on a lower part thereof to jet ink, a carrier 20 having the printer head 30 mounted thereon, and chassis 10 to fix both ends of a carrier shaft 50 and a guide rail 11 to guide movements of the carrier 20. The carrier 20 is provided with a support bracket 51 and a guide slider 22 on its rear side so that the carrier 20 may move left and right along the carrier shaft 50 and the guide rail 11.

Accordingly, when a sheet of paper 40 picked up by a pickup roller (not shown) from a paper supply tray or cassette passes below the printer head 30 through a paper supply roller 60, the printer head 30 moves to the left and right along the carrier shaft 50 and the guide rail 11 by the carrier 20 and jets ink through the nozzle 31 for a printing operation. After the printing operation, the sheet of paper 40 is discharged through a paper discharge roller 70 and a paper discharge backup roller 80.

However, in general, such an inkjet printer as described above has a certain fixed distance between the nozzle 31 and the paper 40 below the printer head 30. Therefore, when the printer prints on envelopes or postcards, two to three times thicker than plain sheets of paper, the distance between the nozzle 31 and a thicker sheet of paper below the printer head 30 comes closer or uneven than that when printing on plain sheets of paper. In this case, ink may be blurred, causing a problem that deteriorates print resolutions.

In order to solve the above problem, a conventional inkjet printer is provided with a head gap adjuster 90 to adjust a gap between the paper 40 and a head depending upon a thickness of the paper 40. The head gap adjuster 90 has a carrier guide 21 provided on the guide slider 22 positioned on an upper part of the carrier 20, a cam 23 having a cam face to move the carrier guide 21 forwards and backwards, a compression spring 24 to compress the carrier guide 21 toward the cam 23, and a spring guide 25 to accommodate and support the compression spring 24.

When operating the head gap adjuster 90, the head gap adjuster 90 rotates the cam 23 in a direction of B to push the carrier guide 21 along the cam face in a case in which a head gap between the printer head 30 and a sheet is widened to print on envelops, post cards, etc.

At this time, the spring guide 25 is fixed to the carrier 20, so that the carrier guide 21 is biased in a direction of D due to a repelling force of the compression spring 24. However, the guide slider 22 elastically coupled to the carrier guide 21 is arranged not to move back and forth but to slide to the left and right along the guide rail 11, so that the guide slider 22 does not move and the spring guide 25 is pushed back by an eccentric amount of the cam face of the cam 23.

Accordingly, the spring guide 25 is pushed back so that the carrier 20 having the printer head 30 rotates in a direction of C about a rotation shaft of the carrier shaft 50, by which the carrier 20 is ascended in order for a front portion thereof, that is, a front portion of the nozzle 31 of the printer head 30, to be lifted about the carrier shaft 50.

Whereas, in the case that the gap between the printer head 30 and the sheet 40 is narrowed to print on normal sheets of paper, the cam 23 rotates in a direction opposite to the above, so that the carrier 20 is descended to the original position about the carrier shaft 50.

However, such a conventional inkjet printer as described above has a structure to lift up the front portion of the carrier 20 to widen and narrow the gap between the paper 40 and the printer head 30, causing a problem that the nozzle 31 of the printer head 30 is arranged skew with respect to the paper. In this case, a height difference occurs between both ends of the nozzle 31, causing a problem in that resolutions at the start and end positions where the nozzle 31 prints on the paper 40 become different.

Further, the conventional inkjet printer may be advantageous in that the gap between the printer head 30 and the paper 40 may be adjusted by a relatively simple structure thereof, but disadvantageous in that a user has to operate the cam 23 depending on the kinds of paper in order to adjust the head gap. In light of the above, the conventional inkjet printer becomes troublesome and inconvenient as well as causes the possibility of printer malfunctions.

In order to solve the above problem, as shown in FIG. 3, a head gap adjuster has been proposed in which both ends 50" and 50'" of a carrier shaft 50' are structured in a shape of an eccentric cam having a certain eccentric amount δ, and a power transfer device driven by a separate driving motor is connected to the carrier shaft 50', so that the carrier shaft 50' rotates to descend and ascend a carrier 20', thereby to adjust a gap between a print head 30' and a sheet of paper 40' by rotating the carrier shaft 50'. However, the adjuster employs an extra driving motor and a power transfer device, causing a problem in that manufacture cost increases as well as the printer size becomes bigger since space in which the extra driving motor and the power transfer device are installed must be secured.

Further, the head gap adjuster does not have a sensor to detect the head gap states (e.g., a 'narrow' position or 'wide' position). Thus, a controller for the printer would not recognize a current head gap state when the printer is turned on.

Accordingly, every time power is turned on, the printer sets an initialization gap, for example, to the 'narrow' position by performing a head gap initialization process to set a current head gap state, and then adjusts a specific head gap as required.

As stated above, every time the printer is turned on, the conventional head gap adjuster performs the head gap initialization process to set an initialization gap to the 'narrow' position, causing a problem in that an initial arrangement time period to print becomes longer and noise generated due to the head gap initialization process is added to the printer.

SUMMARY OF THE INVENTION

Accordingly, it is an aspect of the present invention to provide an apparatus and method of adjusting a head gap in an inkjet printer which may automatically adjust a gap between a sheet of paper and a printer head depending on changes of sheet thickness.

It is another aspect of the present invention to provide an apparatus and method of adjusting a head gap in an inkjet printer, without using an extra driving motor, and by using driving forces of a carrier driving motor and a paper supply roller driving motor.

It is yet another aspect of the present invention to provide an apparatus and method of adjusting a head gap in an inkjet printer which uses a non-volatile memory rather than an extra head gap sensor to adjust a head gap position so that a head gap initialization process is not performed every time a printer is turned on, thereby reducing a period of time for a printing operation to start and reducing noise due to the head gap initialization process.

Additional aspects and advantages of the invention will be set forth in part in the description which follows and, in part, will be obvious from the description, or may be learned by practice of the invention.

The foregoing and/or other aspects of the present invention are achieved by providing an apparatus to adjust a head gap in an inkjet printer having a carrier provided with a printer head having nozzles to jet ink, a chassis provided with a carrier shaft to guide movements of the carrier, a carrier driving unit to move the carrier left and right along the carrier shaft, and a paper supply roller driving unit to drive a paper supply roller which supplies sheets of paper to be printed on. The apparatus includes a carrier ascent/descent unit to rotate the carrier shaft with respect to the carrier to ascend and descend the carrier in order to adjust a head gap between the nozzles of the printer head and a respective sheet of paper. The apparatus also includes a clutch unit to transfer a driving force of the paper supply roller driving unit to the carrier ascent/descent unit by the carrier which moves by the carrier driving unit upon the adjustment of the head gap, and a control unit to store an adjusted head gap state and to adjust a head gap position required based on the stored adjusted head gap state.

According to an aspect of the invention, the clutch unit includes a clutch part to transfer or cut off the driving force of the paper supply roller driving unit to or from the carrier shaft, and an operation part to operate the clutch part to transfer the driving force of the paper supply roller driving unit to the carrier shaft.

According to another aspect of the invention, the clutch part includes an eccentric rotation gear fixed to one end of the carrier shaft, and a clutch disposed on the chassis to connect or disconnect the paper supply roller driving unit and the eccentric rotation gear.

According to another aspect of the invention, the carrier ascent/descent unit includes both ends of the carrier shaft which form eccentric cams eccentric by a certain amount with respect to a center of the carrier shaft, and a support bushing to support the both ends of the carrier shaft.

According to yet another aspect of the invention, the clutch includes a first clutch gear meshed with the paper supply roller driving unit, a second clutch gear coaxially connected with the first clutch gear and disposed to move between a power transfer position at which the first clutch gear and the eccentric rotation gear are coupled and a power cutoff position at which the first clutch gear and the eccentric rotation gear are released. The clutch also includes an elastic spring to elastically press the second clutch gear in order for the second clutch gear to be located at the power cutoff position.

According to an aspect of the invention, the operation part includes a plate-shaped member slidably disposed in the chassis in order to push the second clutch gear to the power transfer position when the operation part is pushed by the carrier.

According to an aspect of the invention, the operation part includes a damping portion to absorb shocks excessively transferred to the clutch when the operation part is pushed by the carrier.

According to an aspect of the invention, the control unit includes a non-volatile memory to store the adjusted head gap state, and the non-volatile memory is selected from a group consisting of NVRAM, EEPRAM, and flash memories.

According to an aspect of the invention, the head gap adjustment apparatus includes a stopper member to restrict the eccentric rotation gear to rotate between the power transfer and power cutoff positions.

According to another aspect of the invention, the stopper member includes a protrusion to protrude toward the eccentric rotation gear from the chassis, and two traverse walls provided in a groove of the eccentric rotation gear to be coupled with the protrusion.

The foregoing and/or other aspects of the present invention are achieved by providing a method of adjusting a head gap in an inkjet printer includes receiving a head gap adjustment command from a control unit, reading out a head gap state stored in a non-volatile memory of the control unit, and comparing a head gap position to be adjusted according to the received head gap adjustment command to the head gap state read out from the non-volatile memory. The method also includes adjusting the head gap position when the head gap position to be adjusted does not match the read-out head gap state as a result of the comparison, and storing an adjusted head gap state and waiting for printing.

According to an aspect of the invention, the adjusting the head gap position includes controlling the carrier driving unit to drive the carrier to be moved toward the head gap adjustment position along the carrier shaft, and controlling the paper supply roller driving unit to generate a driving force when the carrier is disposed at the head gap adjustment position in order for the carrier shaft to move with respect to a paper path.

According to an aspect of the invention, the controlling the paper supply roller driving unit includes selectively transferring the driving force to the carrier shaft in response to the movements of the carrier, and terminating the transfer of the driving force to the carrier shaft in response to the movements of the carrier outside the head gap adjustment position from the head gap adjustment position.

According to another aspect of the invention, the adjusting the head gap position includes automatically adjusting the head gap in response to the driving force of the carrier driving unit and the paper supply roller driving unit without using an extra driving motor.

According to an aspect of the invention, the method includes initializing the head gap adjustment apparatus.

According to an aspect of the invention, the initializing includes storing an arbitrary head gap position in the non-volatile memory upon the manufacture of a printer, reading out the head gap state stored in the non-volatile memory, setting a head gap state flag corresponding to the read-out head gap state, and initializing a mechanism.

The foregoing and/or other aspects of the present invention are achieved by providing an inkjet printer which includes a carrier provided with a printer head having nozzles to jet ink, a carrier shaft to guide movements of the carrier, and a head gap adjustment device including a carrier ascent/descent unit to rotate the carrier shaft with respect to the carrier to ascend and descend the carrier in order to adjust a head gap between the nozzles of the printer head and a sheet of paper. The head adjustment device includes a control unit provided with a non-volatile memory to store a head gap state and to adjust a head gap position required based on the head gap state stored in the non-volatile memory.

BRIEF DESCRIPTION OF THE DRAWINGS

The above and/or other aspects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
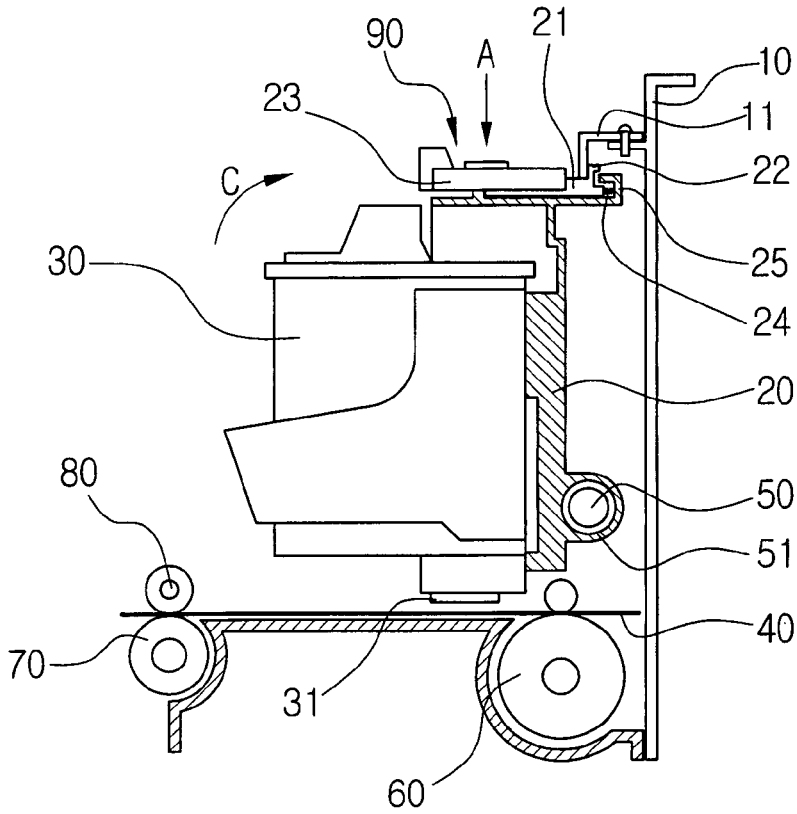
FIG.1 (PRIOR ART)
FIG. 1 is a side view of a carrier assembly of a conventional inkjet printer.
Figure 2:
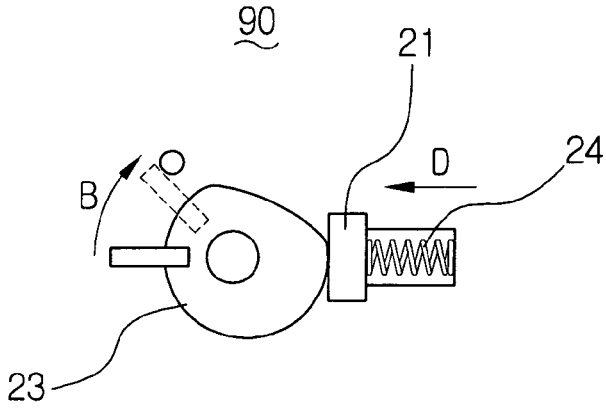
FIG.2 (PRIOR ART)
FIG. 2 is a plan view of a head gap adjuster shown in a direction of A in FIG. 1.
Figure 3:
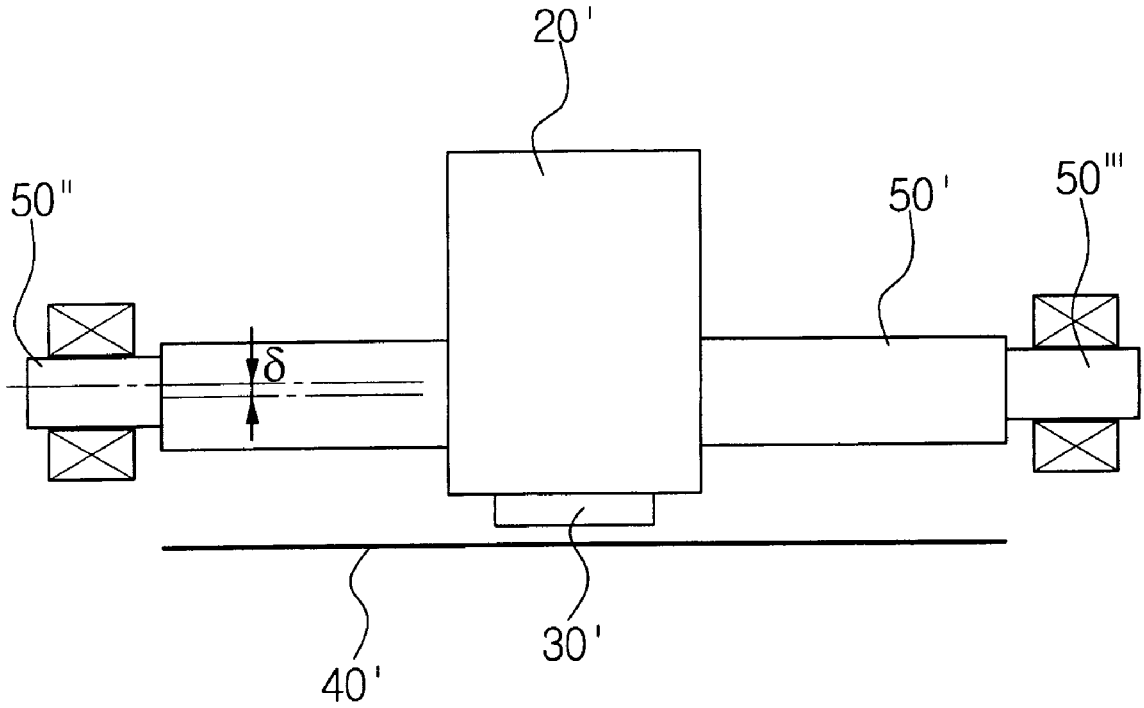
FIG.3 (PRIOR ART)
FIG. 3 is a conceptual view of a head gap adjuster of another conventional inkjet printer.

Reference will now be made in detail to the present preferred embodiments of the present invention, examples of which are illustrated in the accompanying drawings, wherein like reference numerals refer to like elements throughout.

Figure 4:
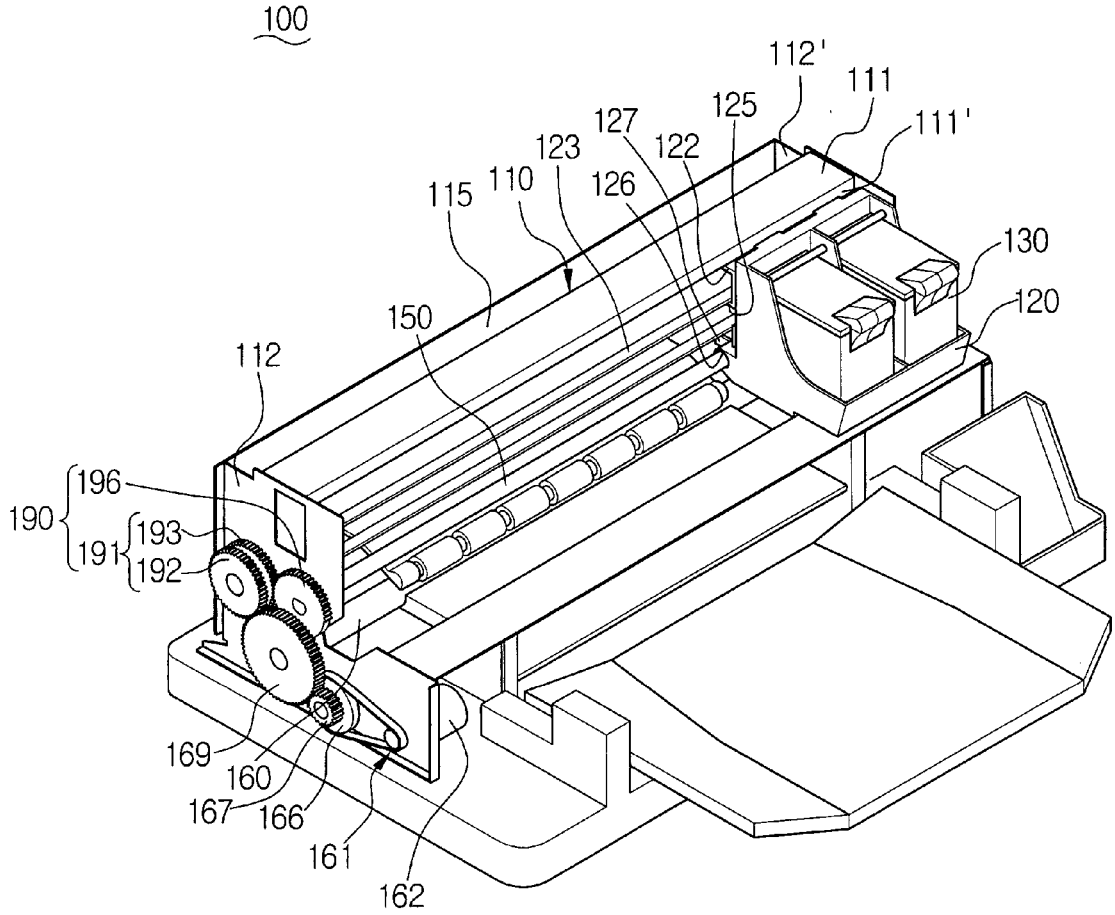
FIG. 4 is a partial perspective view of an inkjet printer to which a head gap adjuster, according to an embodiment of the present invention is applied.

An inkjet printer 100 to which a head gap adjuster of the present invention is applied, is shown in FIG. 4. The inkjet printer 100 includes a carrier 120 having a printer head 130 provided with nozzles to jet ink, a chassis 110 provided with side frames 112 and 112' to support a carrier shaft 150 and a guide rail 111 to guide movements of the carrier 120, and a carrier driving unit 121 (refer to FIG. 5) to move the carrier 120 left and right along the carrier shaft 150. The inkjet printer 100 also includes a paper supply roller driving unit 161 to drive a paper supply roller 160 supplying sheets of paper to be printed thereon, and a head gap adjuster 200 to rotate, ascend, and descend the carrier shaft 150 to adjust a gap between the nozzles of the printer head 130 and a respective sheet of paper.

The carrier 120 is provided with a guide slider 122 formed on an upper rear side thereof in order for the carrier 120 to move to the left and right while in contact with a vertical wall 111' of the guide rail 111, and a support bracket 126 to accommodate the carrier shaft 150 in order for the carrier 120 to move to the left and right.

Figure 5:
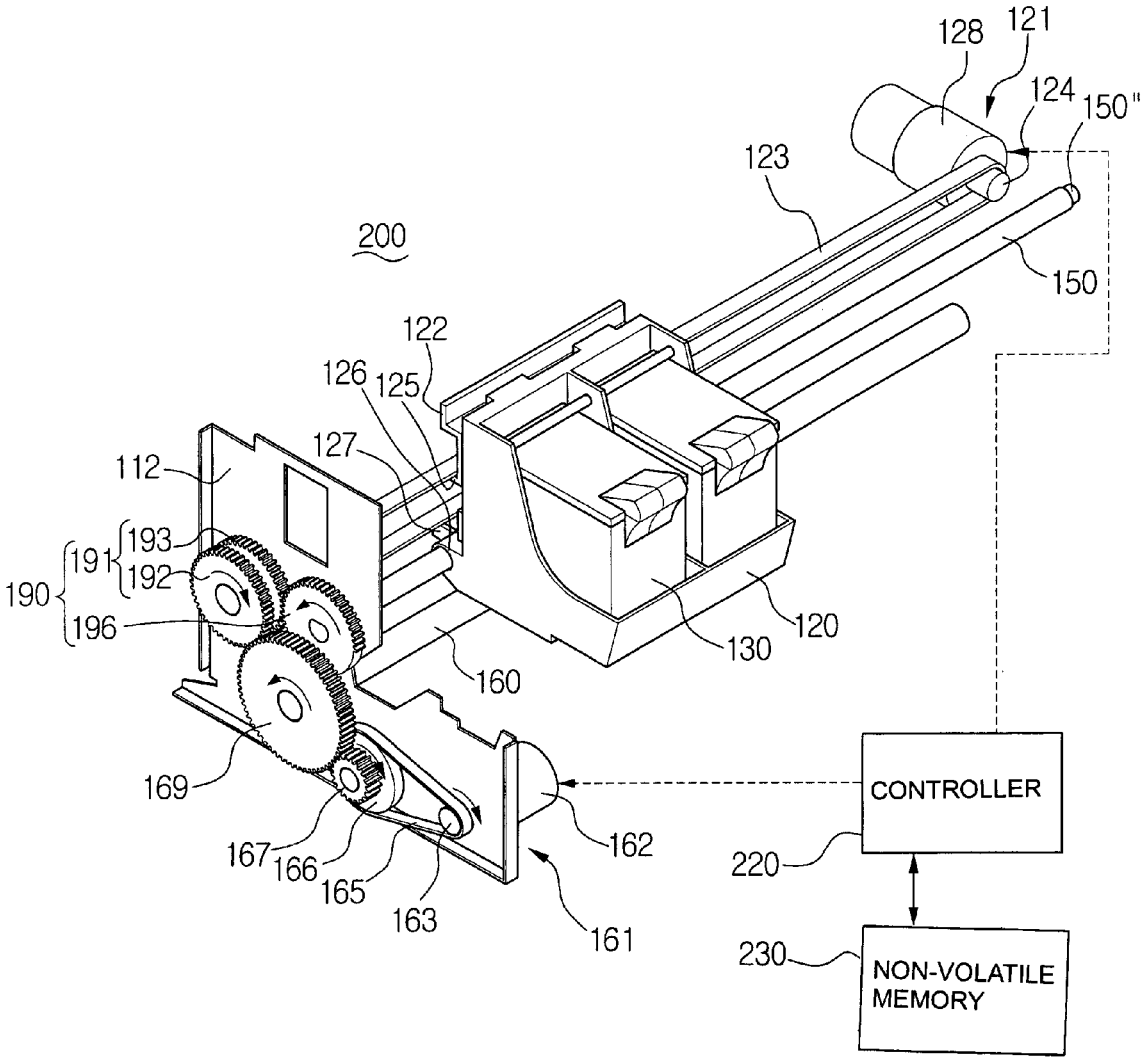
FIG. 5 is a partial perspective view of the head gap adjuster shown in FIG. 4.

As shown in FIG. 5, the carrier driving unit 121 is provided with a carrier driving motor 128 fixed to a rear frame 115 of the chassis 110, and a carrier driving belt 123 coupled to a driving gear 124 of the carrier driving motor 128 to transfer a dynamic power of the carrier driving motor 128 to a power transfer tooth portion 125 provided on the rear side of the carrier 120 so that the carrier 120 moves to the left and right.

A paper supply roller driving unit 161 is provided with a paper supply roller driving motor 162 fixed on a lower part of the side frame 112, a power transfer pulley 166 coupled to a driving pulley 163 of the paper supply roller driving motor 162 through a power transfer belt 165 and having a power transfer gear 167, and a paper supply roller driving gear 169 meshed with the power transfer gear 167.

The head gap adjuster 200 is provided with a carrier ascent/descent unit 113 (refer to FIGS. 6A, 6B, 6C and 8) to descend and ascend the carrier 120 provided with the printer head 130. The head gap adjuster 200 is also provided with a clutch unit 190 and an operation part 201 to transfer a driving force of the paper supply roller driving unit 161 to the carrier shaft 150 in order to rotate the carrier shaft 150 with respect to the carrier 120 when adjusting the head gap, so that the carrier 120 descends or ascends through the carrier ascent/descent unit 113. The head gap adjuster 200 includes a controller 220 (FIG. 5) to store an adjusted head gap state and to adjust a head gap position required according to the stored head gap state.

Figure 8:
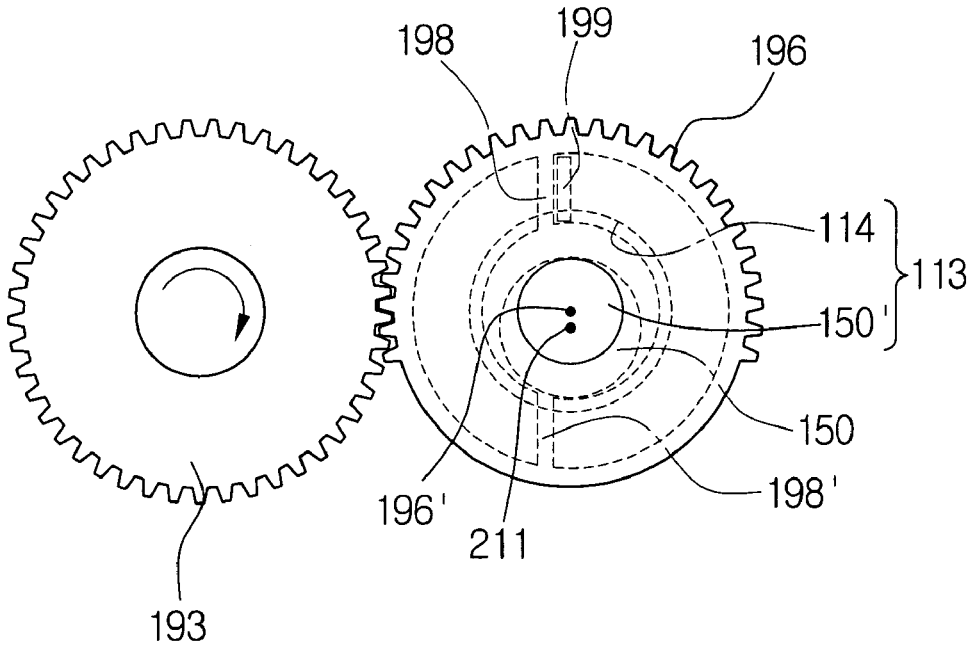
FIG. 8 is a partial side view illustrating operations of a carrier ascent and descent unit and the eccentric rotation gear in the head gap adjuster shown in FIG. 4.

As shown in FIG. 8, the carrier ascent/descent unit 113 is constructed with both ends 150' and 150" of the carrier shaft 150 forming an eccentric cam in order for the center axis 196' (refer to FIG. 8) of the eccentric cam to become eccentric by a certain amount with respect to a center axis 211 of the carrier shaft 150. The carrier ascent/descent unit 113 is also constructed with support bushings 114 respectively disposed on the side frames 112 and 112' of the chassis 110 to accommodate and support both ends 150' and 150" of the carrier shaft 150.

A cross section of the carrier shaft 150 and the both ends 150' and 150" are shaped circular. In order to rotate the carrier shaft 150 via an eccentric rotation gear 196 (to be described later), the one end 150' of the both ends 150' and 150" is welded to a support opening 159 of the eccentric rotation gear 196 or fixed to it by a coupling key (not shown).

Accordingly, as the both ends 150' and 150" of the carrier shaft 150 having the center axis 196' eccentric with respect to the center axis 211 of the carrier shaft 150 rotate in the support bushings 114 by the clutch unit 190 and the eccentric rotation gear 196, the carrier shaft 150 rotates about the center axis 196' of the both ends 150' and 150" thereof. Therefore, the carrier 120 fixed to the carrier shaft 150 through the support bracket 126 may upwardly ascend or downwardly descend by a distance allowed for the center axis 211 of the carrier shaft 150 to vertically move (that is, by twice as much as the eccentric amount of the center axis 196' of the both ends 150' and 150" with respect to the center axis 211).

At this time, the guide slider 122 of the carrier 120 is guided along the vertical wall 111' of the guide rail 111, by which the nozzles of the printer head 130 mounted in the carrier 120 are guided to horizontally ascend without being slanted forwardly or backwardly.

In FIG. 5 and FIG. 6, the clutch unit 190 includes a clutch part to transfer or cut off a rotation force of the paper supply roller driving gear 169 to the carrier shaft 150, and the operation part 201 operates the clutch unit 190 to transfer a rotation force of the paper supply roller driving gear 169 to the carrier shaft 150.

The clutch part unit has the eccentric rotation gear 196 provided on the one end 150' of the carrier shaft 150, and a clutch 191 disposed on the side frame 112 to connect or disconnect the paper supply roller driving gear 169 and the eccentric rotation gear 196.

Figure 7:
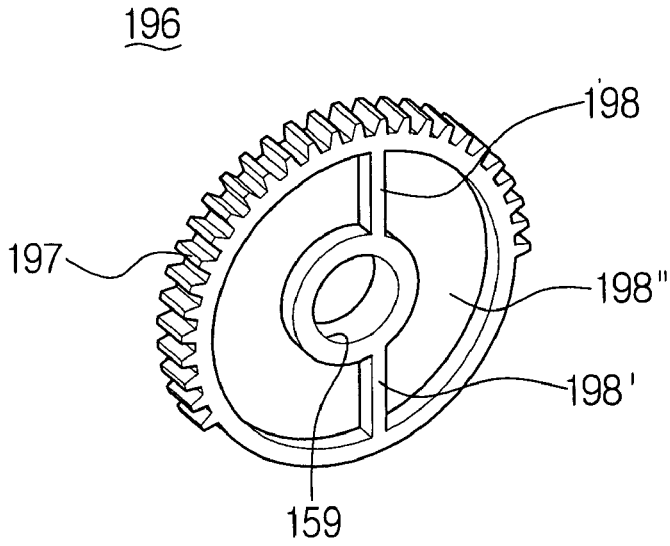
FIG. 7 is a perspective view of an eccentric rotation gear for the head gap adjuster shown in FIG. 4.

As shown in FIG. 7, the eccentric rotation gear 196 has a partial gear 197 provided to mesh with a second clutch gear 193 on a circumferential surface thereof. The reason that the partial gear 197 is formed on the eccentric rotation gear 196 is because it is not necessary for the carrier shaft 150 to rotate 360 degrees in order to ascend or descend the carrier 120.

On one side of the eccentric rotation gear 196 is provided a groove 198" to form space in which a protrusion 199 of a stopper member (to be later described) moves, and two traverse walls 198 and 198' provided in the groove 198" to mesh with the protrusion 199 to block the rotations of the eccentric rotation gear 196.

The clutch 191 includes a rotation shaft 194 fixed to the side frame 112, and a first clutch gear 192 having a toothed portion supported to rotate on the rotation shaft 194 and meshed with the paper supply roller driving gear 169 on a circumferential surface thereof. The clutch 191 also includes a second clutch gear 193 having a toothed portion supported on the rotation shaft 194 and meshed with the eccentric rotation gear 196 on a circumferential surface thereof, and an elastic spring 195 supported by the rotation shaft 194 between the first clutch gear 192 and the second clutch gear 193.

The first and second clutch gears 192 and 193 have clutch teeth 192', 193' respectively provided on their opposite surfaces to each other. The second clutch gear 193 may move between a power transfer position (refer to FIG. 6C) at which the second clutch gear 193 is meshed with the first clutch gear 192 and the eccentric rotation gear 196, and a power cutoff position(refer to FIG. 6A) at which the second clutch gear 193 is meshed with the eccentric rotation gear 196 and released from the first clutch gear 192. However, the second clutch gear 193 is positioned at the power cutoff position by the elastic spring 195 during normal operations after the head gap adjustment.

The elastic spring 195 is preferably arranged between the first clutch gear 192 and the second clutch gear 193, but may be arranged to be supported by the rotation shaft 194 through the first clutch gear 192 so as to elastically press the second clutch gear 193.

Figure 6A:
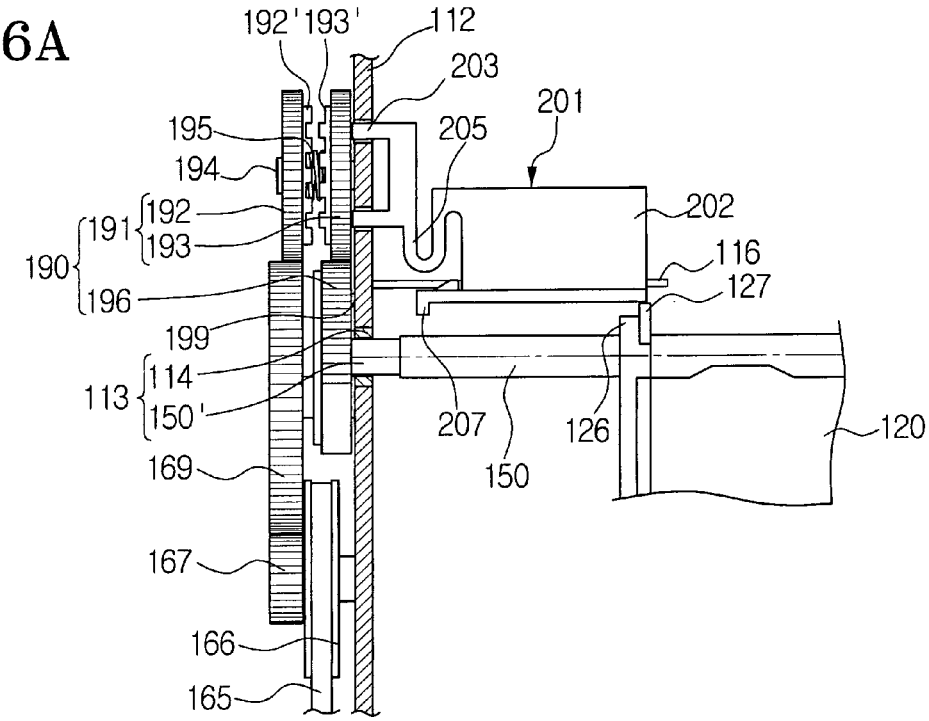
FIGS. 6A, 6B, and 6C are partial cross-sectioned views of the head gap adjuster shown in FIG. 4.
Figure 6B:
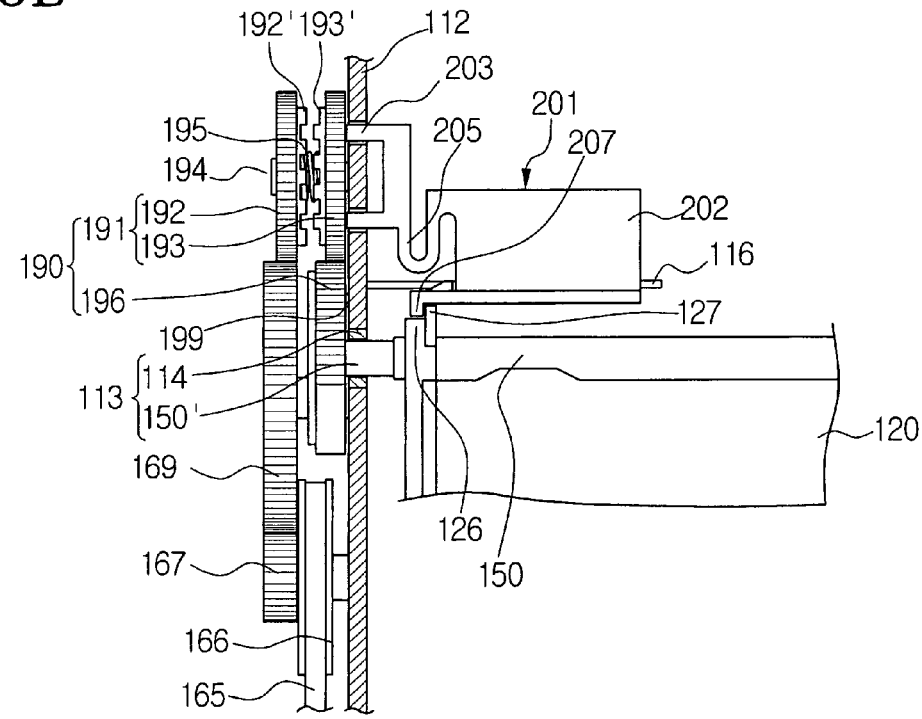
Figure 6C:
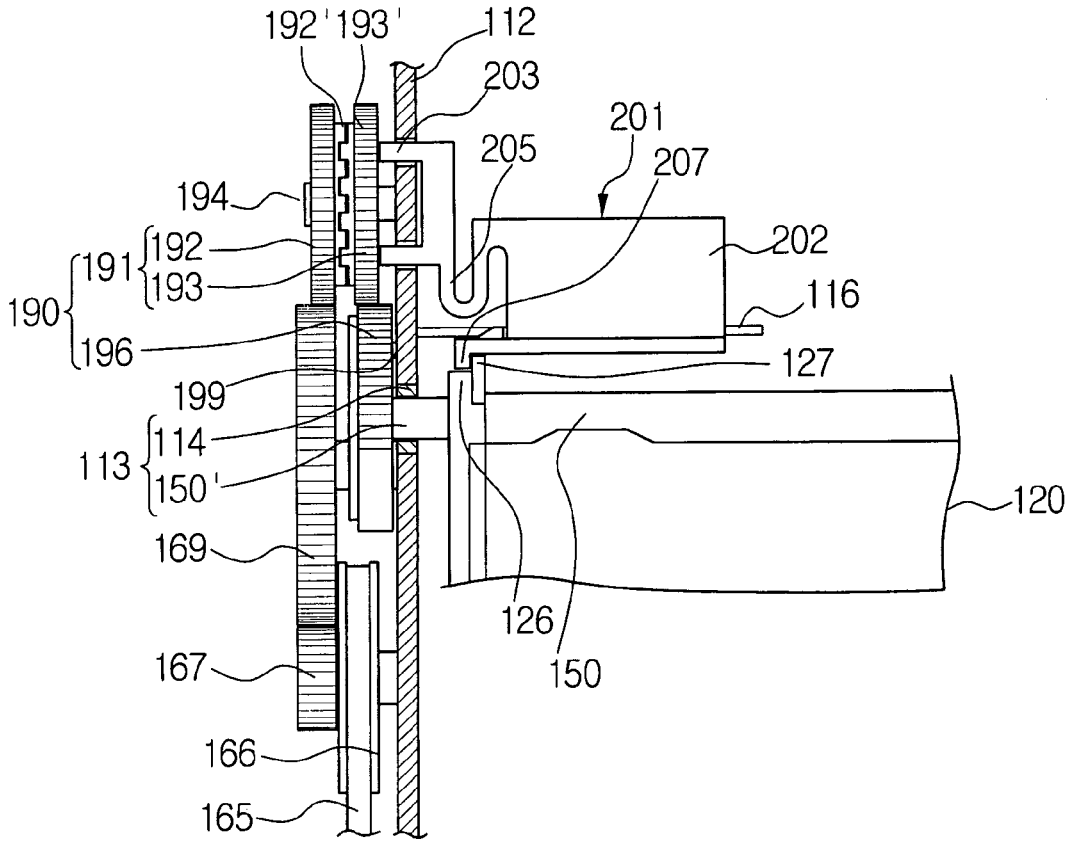

As shown in FIGS. 6A, 6B and 6C, the operation part 201 is constructed with a plate-shaped member slidably disposed on the guide 116 of the side frame 112 to push the second clutch gear 193 to the power transfer position when pushed by the carrier 120. The operation part 201 has a collision contact portion 207 shorter than or equal to a length of 10 mm which comes in contact with an operation protrusion 127 provided adjacent to the support bracket 126 of the carrier 120. The operation part 201 also includes a movement slide 202 slidably disposed to the guide 116 of the side frame 112, and a c-shaped operation bar 203 to transfer a collision force of the operation protrusion 127 to the second clutch gear 193.

Alternatively, the operation part 201 may include a damping portion 205 to prevent an excessive collision force from being applied to the clutch 191 when the operation protrusion 127 of the carrier 120 collides with the collision contact portion 207. The damping portion 205 is constructed with an U-shaped coupler which elastically connects the movement slide 202 and the operation bar 203.

The controller 220 includes a non-volatile memory 230 (FIG. 5) to store head gap adjustment positions. The non-volatile memory 230 is preferably selected from a group consisting of an NVRAM, an EEPRAM, and a flash memory.

Further, as shown in FIG. 8, the head gap adjuster 200 includes the stopper member which restricts the eccentric rotation gear 196 and fixes the one end 150' of the carrier shaft 150 into a supporting hole 159 to rotate only between two positions. The stopper member is constructed with the protrusion 199 to protrude toward the eccentric rotation gear 196 from the side frame 112, and the two traverse walls 198 and 198' provided in the groove 198" of the eccentric rotation gear 196 to be coupled with the protrusion 199.

The traverse walls 198 and 198' are formed in an angle to each other, for example, about 180°, to correspond to positions at which the carrier 120 completely ascends and descends so that the traverse walls 198 and 198' are coupled with the protrusion 199 to stop the rotation of the eccentric rotation gear 196. That is, the places at which the two traverse walls 198 and 198' are located are the ones that correspond respectively to a 'wide' position for envelops, postcards, etc., and a 'narrow' position for normal papers which completely ascend and descend the carrier 120 to increase and reduce the head gap, according to the eccentric amount of the both ends 150' and 150" of the carrier shaft 150 as they rotate in the support bushing 114.

Accordingly, when the paper supply roller driving motor 162 is driven in a state that the second clutch gear 193 is located at the power transfer position which the second clutch gear 193 is coupled with the first clutch gear 192 and the eccentric rotation gear 196, the eccentric rotation gear 196 rotates by an angle, that is, 180°, between the two transverse walls 198 and 198' due to the protrusion 199 in order to adjust the head gap.

A process of initializing the head gap adjuster 200 for an inkjet printer constructed as above, will be described in detail with reference to FIG. 9.

Figure 9:
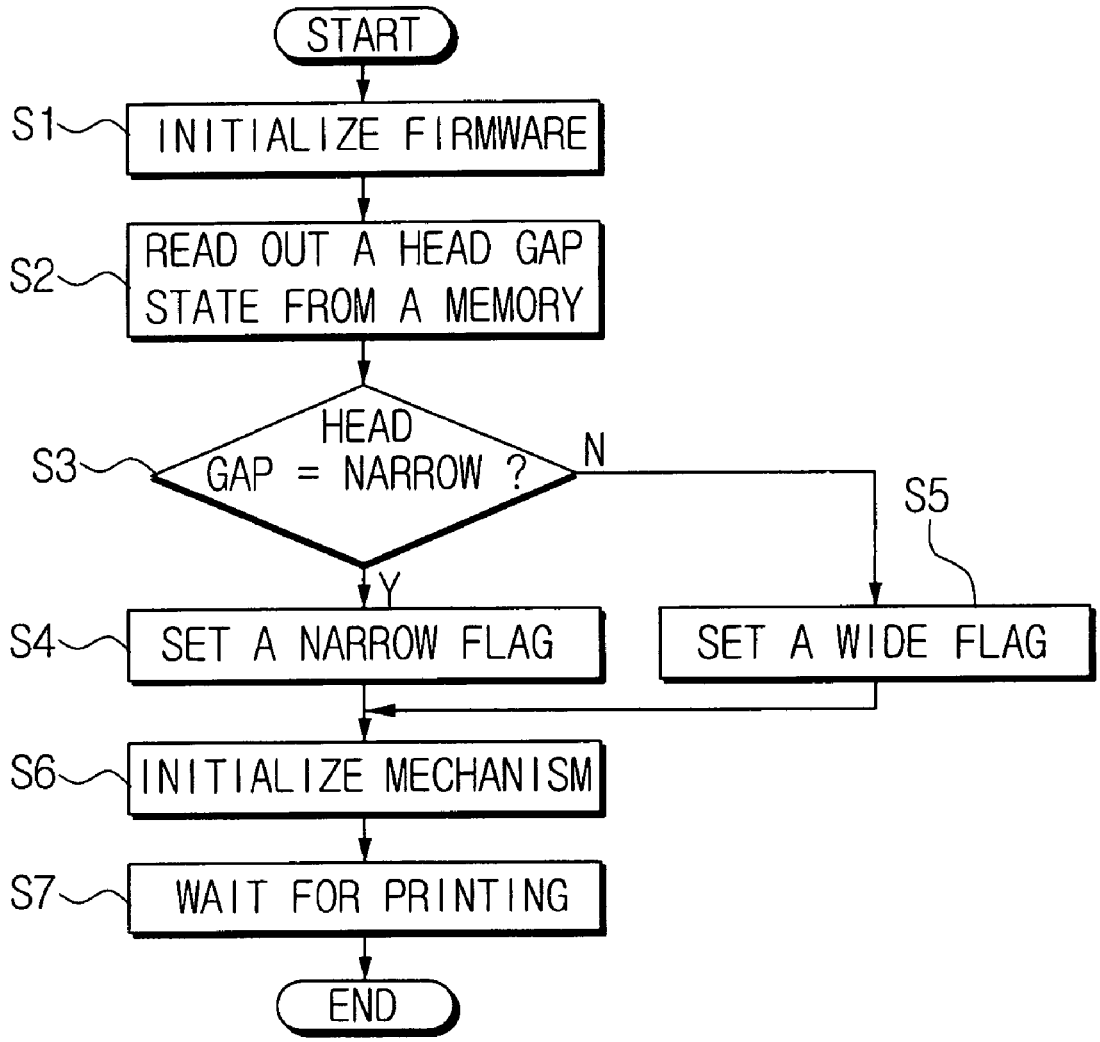
FIG. 9 is a flow chart of an initialization process for the head gap adjuster of FIG. 4.

First, as shown in an initialization flow chart of FIG. 9, after assembling a printer, the controller 220 performs a firmware initialization process in which a gap between a sheet of paper and the printer head 130 is stored as an arbitrary gap position ('narrow' position or 'wide' position) into the non-volatile memory 230 such as an NVRAM of the controller 220 in operation S1.

Thereafter, the printer is turned 'off' and then 'on', and the controller 220 reads a stored head gap state from the NVRAM 230 (in operation S2), and decides whether the read head gap state is at the 'narrow' position (in operation S3).

As a result of the decision, when at the narrow position, the controller 220 sets a narrow flag in the NVRAM 230 (in operation S4), and, when at the wide position, the controller 220 sets a wide flag (in operation S5).

Thereafter, the controller 220 initializes the mechanism of the head gap adjuster 200 according to a corresponding flag (in operation S6), and, when the mechanism initialization is completed, the printer sets in a print waiting state (in operation S7).

The initialization process of the head gap adjuster 200 is performed only once when a printer is being manufactured.

After the head gap adjuster 200 is completely initialized as stated above, a process to adjust a head gap by using the head gap adjuster 200 of the present invention is performed, which is described with reference to FIG. 10 below.

Figure 10:
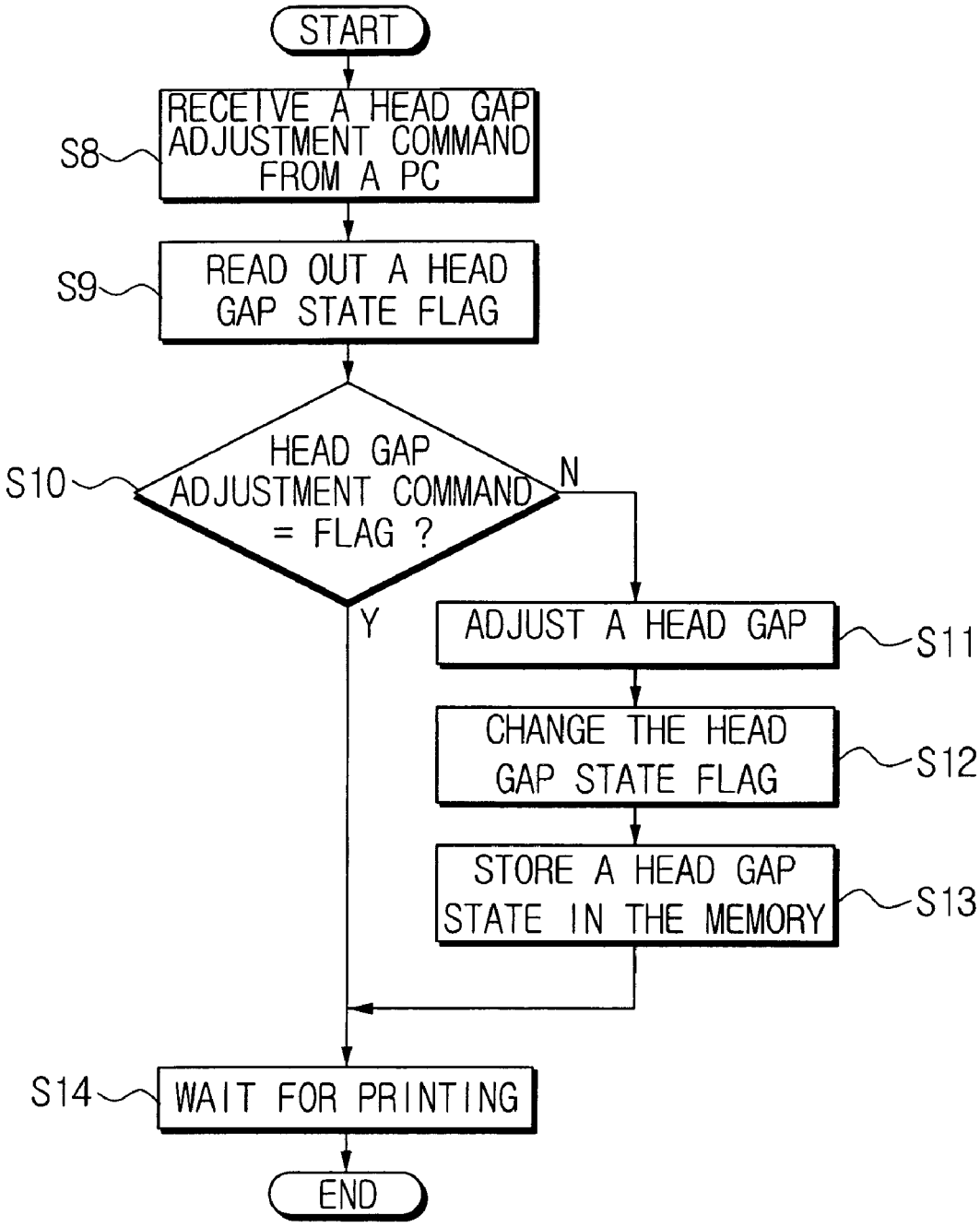
FIG. 10 is a flow chart of a head gap adjustment process for the head gap adjuster shown in FIG. 4.

As shown in a head gap adjustment flow chart of FIG. 10, after a printer is turned 'on', the controller 220 receives a head gap adjustment command by a 'head gap adjustment' or 'paper selection' button (not shown) on a control panel (not shown) (in operation S8).

After receiving the head gap adjustment command, the controller 220 reads in a head gap state flag set upon the initialization from the NVRAM 230 (in operation S9), and decides whether a head gap position to be adjusted according to the head gap adjustment command is the same as the read head gap state flag (in operation S10).

When the head gap position to be adjusted is not the same as the read head gap state flag as a result of the decision, the controller 220 adjusts the head gap position according to the head gap adjustment command (in operation S11). After the head gap position is adjusted by the head gap adjuster 200 according to the head gap adjustment command as later described below, the controller 220 changes the head gap state flag (in operation S12), and stores the changed head gap state flag into the NVRAM (in operation S13). Thereafter, the printer is completely ready and waits for printing (in operation S14).

At this time, when the head gap position to be adjusted is the same as the read head gap state flag, the printer immediately waits for printing (in operation S14).

Next, the process of adjusting a head gap position by using the head gap adjuster 200 in operation S11 is described below with reference to FIG. 4 to FIG. 8.

Assuming that a current head gap state of the printer is the 'narrow' position and a head gap position to be adjusted is the 'wide' position, as shown in FIG. 6A, the carrier driving motor 128 moves the carrier 120 to the operation part 201 located outside a printing reciprocation section through the driving belt 123 and the power transfer tooth portion 125 according to a command of the controller 220.

As shown in FIG. 6B, when the carrier 120 reaches the operation part 201, the operation protrusion 127 of the carrier 120 contacts and collides with the collision contact portion 207 of the operation part 201. Accordingly, the operation bar 203 of the operation part 201 moves the second clutch gear 193 against the elastic force of the elastic spring 195 to the power transfer position at which the second clutch gear 193 is meshed with the first clutch gear 192. At this time, an impact force excessively applied to the collision contact portion 207 by the operation protrusion 127 is absorbed by the damping portion 205.

As shown in FIG. 6C, when the carrier 120 stops after the second clutch gear 193 is completely meshed with the first clutch gear 192, the controller 220 drives the paper supply roller driving motor 162, for example, in the clockwise direction as shown in FIG. 5, and rotates a first clutch gear 192 in the clockwise direction through the power transfer pulley 166, the power transfer gear 167, and the paper supply roller driving gear 169. Accordingly, the second clutch gear 193 rotates in the clockwise direction, and, as shown in FIG. 8, the eccentric rotation gear 196 meshed with the second clutch gear 193 rotates in a counterclockwise direction with respect to the center axis 196' of the both ends 150' and 150" of the carrier shaft 150.

As the eccentric rotation gear 196 rotates in the counterclockwise direction, the both ends 150' and 150" of the carrier shaft 150 of which the center axis 196' has a certain eccentric amount as to the center axis 211 of the carrier shaft 150, rotate with respect to the support bushings 114. Therefore, the carrier shaft 150 supported on the carrier 120 through the support bracket 126 rotates with respect to the center axis 196' of the both ends 150' and 150" in the support bracket 126, and ascends by a distance that the center axis 211 vertically moves.

As the carrier shaft 150 ascends, the carrier 120 supported by the carrier shaft 150 upwardly ascends as well. At this time, the carrier 120 guides the guide slider 122 to vertically move along the vertical wall 111' of the guide rail 111, so the nozzles of the printer head 130 mounted in the carrier 120 are not slanted back and forth but maintained horizontally.

When the protrusion 199 provided on the side frame 112 comes across the traverse wall 198' with the eccentric rotation gear 196 rotated by about 180°, the rotation of the eccentric rotation gear 196 is cut off, and the controller 220 stops the operation of the paper supply roller driving motor 162. At this time, the carrier 120 fully ascends to the 'wide' position to maintain a gap between the nozzles of the printer head 130 and a respective sheet of paper in a state suitable to print on envelopes, etc.

Thereafter, the carrier 120 moves to a position as shown in FIG. 6B by the controller 220, so that the second clutch gear 193 returns to the power cutoff position at which the second clutch gear 193 is meshed with the eccentric rotation gear 196 by the elastic spring 195 and released from the first clutch gear 192. At this time, the second clutch gear 193 may not be separated from the first clutch gear 192 due to a surface friction of the clutch teeth 192', 193' of the clutch 191. Thus, the paper supply roller driving motor 162 drives the first clutch gear 192 to rotate in the counterclockwise direction by a certain extent.

When the first clutch gear 192 is rotated in the counterclockwise direction by the certain extent, the eccentric rotation gear 196 maintains its position without movements by the contact of the both ends 150' and 150" of the carrier shaft 150 and the support bushing 114, an elastic force of the elastic spring 195 applied toward the side frame 112 with respect to the second clutch gear 193, the coupling of the stopper members 198' and 199, and so on.

Thereafter, the carrier 120 performs printing operations according to a print command of the controller 220.

The operations of adjusting the head gap to the 'narrow' position are performed in the reverse order of the operations described above.

As described above, the apparatus and method of adjusting the head gap in the inkjet printer according to the present invention may automatically adjust the gap between a sheet of paper and the printer head according to changes of a paper thickness.

Further, the apparatus and method of adjusting the head gap in the inkjet printer according to the present invention may adjust the gap between a sheet of paper and the printer head by using the driving forces of the carrier driving motor and the paper supply roller driving motor without using an additional driving motor.

The apparatus and method of adjusting the head gap in the inkjet printer according to the present invention may adjust the head gap positions by using the non-volatile memory without an extra head gap sensor so that a head gap initialization process performed every time the printer is turned on is eliminated, reducing a period of arrangement time for a print start and noise due to the head gap initialization process.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus to adjust a head gap in an inkjet printer having a carrier provided with a printer head which includes nozzles to jet ink, a chassis provided with side frames to support a carrier shaft and a guide rail to guide movements of the carrier, a carrier driving unit to move the carrier left and right along the carrier shaft, and a paper supply roller driving unit to drive a paper supply roller which supplies sheets of paper to be printed on, the apparatus comprising:

a carrier ascent/descent unit to rotate the carrier shaft with respect to the carrier to ascend and descend the carrier in order to adjust a head gap between the nozzles of the printer head and a respective sheet of paper;

a clutch unit to transfer a driving force of the paper supply roller driving unit to the carrier ascent/descent unit by the carrier which moves by the carrier driving unit upon the adjustment of the head gap; and a control unit to store an adjusted head gap state and to adjust a head gap position required based on the stored adjusted head gap state, wherein the clutch unit comprises:

a clutch part to transfer or cut off the driving force of the paper supply roller driving unit to or from the carrier shaft; and an operation part to operate the clutch part to transfer the driving force of the paper supply roller driving unit to the carrier shaft.

2. The apparatus as claimed in claim 1, wherein the clutch part comprises:

an eccentric rotation gear fixed to one end of the carrier shaft; and a clutch disposed on the chassis to connect or disconnect the paper supply roller driving unit and the eccentric rotation gear.

3. The apparatus as claimed in claim 2, wherein the carrier ascent/descent unit comprises:

both ends of the carrier shaft which form eccentric cams having a center axis eccentric by a certain amount with respect to a center axis of the carrier shaft; and support bushings to support the both ends of the carrier shaft.

4. The apparatus as claimed in claim 3, wherein the clutch comprises:

a rotation shaft fixed to one of the side frames;

a first clutch gear having a toothed portion supported to rotate on the rotation shaft and meshed with the paper supply roller driving unit;

a second clutch gear having a toothed portion supported to rotate on the rotation shaft and coaxially connected with the first clutch gear, the second clutch gear being disposed to move between a power transfer position at which the first clutch gear and the eccentric rotation gear are coupled and a power cutoff position at which the first clutch gear and the eccentric rotation gear are released; and an elastic spring supported by the rotation shaft between the first clutch gear and the second clutch gear, to elastically press the second clutch gear so that the second clutch gear is located at the power cutoff position.

5. The apparatus as claimed in claim 4, wherein the operation part comprises:

a plate-shaped member slidably disposed in the chassis to push the second clutch gear to the power transfer position when the operation part is pushed by the carrier.

6. The apparatus as claimed in claim 5, wherein the operation part comprises:

a damping portion to absorb shocks excessively transferred to the clutch when the operation part is pushed by the carrier.

7. The apparatus as claimed in claim 6, wherein the control unit comprises:

a non-volatile memory to store the adjusted head gap state, the non-volatile memory being selected from a group consisting of NVRAM, EEPRAM, and flash memories.

8. The apparatus as claimed in claim 7, further comprising:

a stopper member to restrict the eccentric rotation gear to rotate between the power transfer and power cutoff positions.

9. The apparatus as claimed in claim 8, wherein the stopper member comprises:

a protrusion to protrude toward the eccentric rotation gear from the chassis; and two traverse walls provided in a groove of the eccentric rotation gear to be coupled with the protrusion, blocking rotations of the eccentric rotation gear.

10. The apparatus as claimed in claim 9, wherein the traverse walls are formed in an angle of about 180° to each other to correspond to positions at which the carrier ascends and descends, so that the traverse walls are coupled with the protrusion of the stopper member to block the rotations of the eccentric rotation gear.

11. The apparatus as claimed in claim 6, wherein the operation part further comprises:

an operation protrusion part provided adjacent to the carrier;

a collision contact portion to contact with the operation protrusion;

a movement slide slidably disposed on the chassis; and a operation bar to transfer a collision force of the operation protrusion to the second clutch gear.

12. The apparatus as claimed in claim 11, wherein the damping portion comprises a U-shaped coupler to elastically connect the movement slide and the operation bar.

13. The apparatus as claimed in claim 4, wherein the eccentric rotation gear comprises a partial gear to mesh with the second clutch gear.

14. The apparatus as claimed in claim 3, wherein the carrier shaft is rotated via the eccentric rotation gear, and at least one end of the both ends is fixed to the eccentric rotation gear.

15. The apparatus as claimed in claim 14, wherein the both ends of the carrier shaft having the center axis eccentric with respect to a center axis of the carrier shaft, rotate in the support bushings via the clutch part and the eccentric rotation gear, allowing the carrier shaft to rotate about the center axis of the both ends.

16. The apparatus as claimed in claim 15, further comprising:

a guide slider on the carrier to guide along the guide rail, so that the nozzles of the printer head mounted in the carrier are guided to horizontally ascend without being slanted forward or backward.

17. The apparatus as claimed in claim 15, wherein the carrier ascends and descends by a distance allowed for the center axis of the carrier shaft to vertically move.

18. The apparatus as claimed in claim 3, wherein the clutch comprises:

a rotation shaft fixed to one of the side frames;

a first clutch gear having a toothed portion supported to rotate on the rotation shaft and meshed with the paper supply roller driving unit;

a second clutch gear having a toothed portion supported to rotate on the rotation shaft and coaxially connected with the first clutch gear, the second clutch gear being disposed to move between a power transfer position at which the first clutch gear and the eccentric rotation gear are coupled and a power cutoff position at which the first clutch gear and the eccentric rotation gear are released; and an elastic spring supported by the rotation shaft via the first clutch gear, to elastically press the second clutch gear so that the second clutch gear is located at the power cutoff position.

19. A method of adjusting a head gap in an inkjet printer comprising:

receiving a head gap adjust command to rotate a carrier shaft with respect to a carrier from a control unit;

reading out a head gap state stored in a non-volatile memory of the control unit;

comparing a head gap position to be adjusted according to the received head gap adjust command to the head gap state read out from the non-volatile memory;

adjusting the head gap position when the head gap position to be adjusted does not match the read-out head gap state as a result of the comparison; and storing an adjusted head gap state and waiting for printing, wherein the adjusting the head gap position comprises:

controlling a carrier driving unit to drive the carrier to be moved toward the head gap adjustment position along the carrier shaft; and controlling a paper supply roller driving unit to generate a driving force when the carrier is disposed at the head gap adjustment position in order for the carrier shaft to move with respect to a paper path.

20. The method as claimed in claim 19, wherein the controlling the paper supply roller driving unit comprises:

selectively transferring the driving force to the carrier shaft in response to the movements of the carrier; and terminating the transfer of the driving force to the carrier shaft in response to the movements of the carrier outside the head gap adjustment position from the head gap adjustment position.

21. The method as claimed in claim 19, wherein adjusting the head gap position comprises:

automatically adjusting the head gap in response to the driving force of the carrier driving unit and the paper supply roller driving unit without using an extra driving motor.

22. The method as claimed in claim 19, further comprising: initializing the head gap.

23. The method as claimed in claim 22, wherein the initializing the head gap comprises:

storing an arbitrary head gap position in the non-volatile memory upon manufacturing of the printer;

reading out the head gap state stored in the non-volatile memory;

setting a head gap state flag corresponding to the read-out head gap state; and initializing a mechanism for the head gap.

24. The method as claimed in claim 19, wherein the head gap adjust command is received by one of a head gap adjustment and paper selection button on a control panel of the control unit.

25. An apparatus to adjust a head gap in an inkjet printer, comprising:

a clutch unit;

a carrier provided with a printer head which includes nozzles to jet ink;

a chassis provided with side frames to support a carrier shaft and a guide rail to guide movements of the carrier;

a carrier driving unit to move the carrier left and right along the carrier shaft; and a paper supply roller driving unit to drive a paper supply roller which supplies sheets of paper to be printed on, wherein, the head gap is adjusted by using driving forces of the carrier driving unit and the paper supply roller driving unit without using an additional driving unit, wherein the clutch unit comprises:

a clutch part to transfer or cut off the driving force of the paper supply roller driving unit to or from the carrier shaft; and an operation part to operate the clutch part to transfer the driving force of the paper supply roller driving unit to the carrier shaft.

26. An apparatus to adjust a head gap in an inkjet printer having a carrier provided with a printer head which includes nozzles to jet ink, a chassis provided with side frames to support a carrier shaft and a guide rail to guide movements of the carrier, a carrier driving unit to move the carrier left and right along the carrier shaft, and a paper supply roller driving unit to drive a paper supply roller which supplies sheets of paper to be printed on, the apparatus comprising:

a carrier ascent/descent unit to rotate the carrier shaft with respect to the carrier to ascend and descend the carrier in order to adjust a head gap between the nozzles of the printer head and a respective sheet of paper;

a clutch unit to transfer a driving force of the paper supply roller driving unit to the carrier ascent/descent unit by the carrier which moves by the carrier driving unit upon the adjustment of the head gap; and a control unit to store an adjusted head gap state and having a nonvolatile memory to adjust a head gap position required based on the stored adjusted head gap state, wherein, the nonvolatile memory is used rather than an additional head gap sensor to adjust the head gap position.

* * * * *

UNITED STATES PATENT AND TRADEMARK OFFICE

CERTIFICATE OF CORRECTION

PATENT NO. : 7,036,896 B2
APPLICATION NO. : 10/613196
DATED : May 2, 2006
INVENTOR(S) : Jung-hwan Kim It is certified that error appears in the above-identified patent and that said Letters Patent is hereby corrected as shown below:

Column 12, line 41, change “a operation” to --an operation--

Column 14, line 52, change “nonvolatile” to --non-volatile--

Column 14, line 54, change “nonvolatile” to--non-volatile--

Signed and Sealed this

Fifth Day of September, 2006

JON W. DUDAS
*Director of the United States Patent and Trademark Office*